US007321352B2

(12) United States Patent
Lee et al.

(10) Patent No.: US 7,321,352 B2
(45) Date of Patent: Jan. 22, 2008

(54) LIQUID CRYSTAL DISPLAY AND METHOD FOR DRIVING THE SAME

(75) Inventors: Hyun-Su Lee, Kumi (KR); Young-Gil Kim, Kyungki-do (KR); Byoung-Jun Lee, Seoul (KR); Jun-Pyo Lee, Youngin (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 341 days.

(21) Appl. No.: 10/137,360

(22) Filed: May 3, 2002

(65) Prior Publication Data

US 2003/0001812 A1 Jan. 2, 2003

(30) Foreign Application Priority Data

Jun. 19, 2001 (KR) ..... 2001-34819

(51) Int. Cl.
*G09G 3/36* (2006.01)

(52) U.S. Cl. ..... 345/96; 345/98

(58) Field of Classification Search ..... 345/87, 345/94, 96, 98, 99, 100
See application file for complete search history.

(56) References Cited

U.S. PATENT DOCUMENTS 5,689,282 A * 11/1997 Wolfs et al. ..... 345/100
5,774,099 A * 6/1998 Iwasaki et al. ..... 345/87
5,818,402 A * 10/1998 Park et al. ..... 345/58
6,075,505 A * 6/2000 Shiba et al. ..... 345/87
6,392,626 B1 * 5/2002 Moon ..... 345/94

FOREIGN PATENT DOCUMENTS

JP 10-333119 12/1998
KR 10-0220959 11/1996

OTHER PUBLICATIONS

Korean Patent Abstract, Patent No. 10-0220959, Nov. 21, 1996, 1 p.

* cited by examiner

*Primary Examiner*—Kent Chang
(74) *Attorney, Agent, or Firm*—MacPherson Kwok Chen & Heid LLP

(57) ABSTRACT

A liquid crystal display includes a plurality of gate lines and a plurality of data lines crossing over the gate lines while being electrically insulated from the gate lines. Pixels are placed at the cross regions of the gate and the data lines arranged in a matrix form. Each pixel has a switching circuit connected to the gate and the data lines. Data voltages are fed to the pixels such that the polarity of the pixels is inverted per a pixel group of two or more pixel rows. Gate voltages are applied to the neighboring first and second pixel groups such that the gate voltage applied to the pixel row of the first pixel group close to the second pixel group differs from the gate voltage applied to the pixel row of the first pixel group distant to the second pixel group.

5 Claims, 7 Drawing Sheets

(a) Prior Art (b) Present invention (a)

(b)

LIQUID CRYSTAL DISPLAY AND METHOD FOR DRIVING THE SAME

BACKGROUND OF THE INVENTION

1. Field of the Invention

The present invention relates to a liquid crystal display and a method of driving the same and, more particularly, to a liquid crystal display which is driven by an inversion driving method.

2. Description of the Related Art

Generally, a liquid crystal display structure includes a liquid crystal layer having a dielectric anisotropy sandwiched between two opposing substrates. An electric field is applied to the liquid crystal layer with various in strength, thereby controlling light transmission and displaying the desired picture image.

A plurality of pixel electrodes are arranged on one of the substrates in a matrix form, and counter electrodes are arranged on the other substrate such that they correspond to the pixel electrodes. Each of the electrode pair operates with the interposed liquid crystal thereby forming a liquid crystal cell, and the light transmission characteristic of the liquid crystal cell is selectively controlled by applying voltage to the electrode pair, thereby displaying the desired picture image.

The above-structured liquid crystal displays are representative of portable flat panel displays. Among them, thin film transistor liquid crystal displays (TFT LCD) with thin film transistors as switching circuits have been extensively used.

In such a thin film transistor liquid crystal display, thin film transistors are formed on a substrate such that they correspond to pixels arranged in a matrix form. The substrate with the thin film transistors formed thereon is usually called the "thin film transistor array substrate." A pixel electrode is formed at each pixel of the thin film transistor array substrate such that it receives picture signals depending upon the control of the corresponding thin film transistor. Gate and data lines are formed on the thin film transistor array substrate such that they are connected to the pixel electrodes via the thin film transistors. The data lines cross over the gate lines to thereby define pixels in a matrix form. The gate lines are connected to output terminals of gate driving integrated circuits to receive gate signals and transmit them to the pixel electrodes. The data lines are connected to output terminals of data driving integrated circuits to receive picture signals and transmit them to the pixel electrodes.

FIG. 1 illustrates the conceptual structure of a conventional liquid crystal display. In the drawing, G1 to Gm indicate the gate lines, S1 to Sn indicate the data lines, P indicates the pixel electrode, and TFT indicates the thin film transistor.

When the driving voltage of the same polarity is continuously applied to the liquid crystal cell, the pixel electrode and the counter electrode change electrochemically due to the saturation of ionic impurities in the liquid crystal material, and this deteriorates the display sensitivity and the brightness.

In order to prevent such a defect, the polarity of voltage applied to the liquid crystal cell is required to be inverted in a cyclic manner, and this driving technique is called the "inversion driving technique". Such inversion driving techniques include a frame inversion where the polarity is inverted per a frame, a line inversion where the polarity is inverted per a line, and a dot inversion where the polarity is inverted per a pixel. Among the techniques, the line inversion or the dot inversion is mainly used.

The dot inversion driving technique applies the driving voltages of the opposite polarity to the two pixel electrodes neighboring each other in the column and row directions. A driving voltage of positive polarity is applied to one of the neighboring pixel electrodes, and a driving voltage of negative polarity is applied to the other pixel electrode. This polarity state is inverted per each frame.

The dot inversion driving techniques has two methods. One is a 1 dot inversion driving where the vertically and horizontally neighboring pixel electrodes bear opposite polarity. The other is a 2-1 dot inversion driving where the horizontally neighboring pixel electrodes bear the opposite polarity but the polarity of the vertically neighboring pixel electrodes is inverted per two rows. The 2-1 dot inversion driving technique has several advantages over the 1 dot inversion driving technique. Reduced power consumption and no-flickering at the window screen are examples.

FIG. 2A illustrates the polarity state of pixels in a liquid crystal display where the 2-1 dot inversion driving technique is used. FIG. 2B illustrates the brightness of the pixels shown in FIG. 2A. FIG. 2C illustrates the voltage storage of the pixels shown in FIG. 2A.

In the 2-1 dot inversion driving technique, voltages of the same polarity are applied to the pixel electrodes per two pixel rows. For this reason, as shown in FIG. 2B, the voltage storage between the vertically neighboring pixel electrodes between up and down varies to deteriorate brightness over the entire screen area and forms dim horizontal lines.

As shown in FIG. 2B, when the first pixel row #1 and the second pixel row #2 are charged with the positive (+) polarity, and the positive (+) data is inverted into the negative (−) data at the third pixel row #3, an AC current is generated due to the parasitic capacitance between the pixel electrodes at the second pixel row #2 and the pixel electrodes at the third pixel row #3. This deteriorates the charge rate of the pixel electrodes at the second pixel row #2.

Therefore, among the two pixel rows that receive gray scale voltages of the same polarity, the brightness at the second pixel row becomes lower due to the charge rate deterioration compared to the first pixel row, thereby generating faint difference in brightness per a pixel row, that is, per a gate line.

Furthermore, when voltage delay occurs due to the slew rate without applying an ideal square wave, the charge rate deteriorates at the first pixel row. As a result, in the two pixel rows under receiving voltages of the same polarity, the brightness at the first pixel row is reduced compared to the second pixel row. Therefore, brightness difference occurs even at the pixel rows receiving voltages of the same polarity. Consequently, horizontally extended bands are displayed at the screen while deteriorating the display characteristic.

SUMMARY OF THE INVENTION

It is therefore an object of the present invention to provide a liquid crystal display which bears uniform brightness characteristics over the entire screen area.

This and other objects may be achieved by a liquid crystal display with the following features. The liquid crystal display includes a liquid crystal display panel having a plurality of gate lines. A plurality of data lines cross over the gate lines while being electrically insulated from the gate lines. Pixels are placed at the cross regions of the gate and the data lines in a matrix form. Each pixel has a switching circuit connected to the gate and the data lines. The polarity of the pixels is inverted per a pixel group of two or more pixel rows. The liquid crystal display further includes a data driving unit, and a scan driving unit. The data driving unit feeds gray scale voltages to the data lines. The scan driving unit feeds gate voltages of different levels to the neighboring first and second gate lines.

The scan driving unit feeds a first gate voltage of a predetermined level to the first gate line while feeding a second gate voltage of another predetermined level to the second gate line. The first gate voltage is greater than, or lower than the second gate voltage.

In a method of driving the liquid crystal display, data voltages are fed to the pixels such that the polarity of the pixels is inverted per a pixel group of two or more pixel rows. Gate voltages of different levels are fed to the neighboring first and second gate lines.

A first gate voltage of a predetermined level is fed to the first gate line while feeding a second gate voltage of another predetermined level to the second gate line. The first gate voltage is greater than, or lower than the second gate voltage. The gate voltages fed to the gate lines may bear two or more different values.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components.

DETAILED DESCRIPTION OF THE PREFERRED EMBODIMENTS

Figure 3:
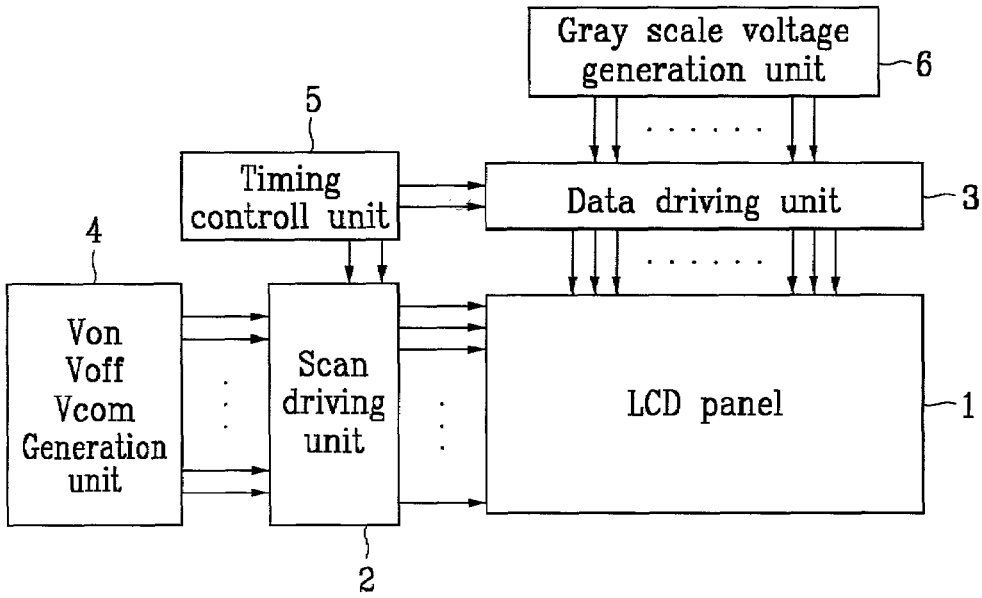
FIG. 3 is a block diagram of a liquid crystal display according to a preferred embodiment of the present invention.

Preferred embodiments of this invention will be explained with reference to the accompanying drawings. FIG. 3 schematically illustrates the structure of a liquid crystal display according to a preferred embodiment of the present invention. As shown in FIG. 3, the liquid crystal display includes an LCD panel 1, a scan driving unit 2, a data driving unit 3, a Von, Voff and Vcom generation unit 4, a timing control unit 5, and a gray scale voltage generation unit 6. Signals are applied to the LCD panel 1 through the data driving unit 3 and the scan driving unit 2.

A plurality of gate lines are formed in the LCD panel 1 to transmit gate driving signals. A plurality of data lines are also formed in the LCD panel 1 and cross over the gate lines to transmit gray scale voltages carrying picture signals. A pixel is formed at a region where one data line crosses over one gate lines. That is, the pixels are arranged in a matrix form.

The data driving unit 3, usually called the "source driving unit", loads voltages to the pixels within the LCD panel 1. Specifically speaking, the data driving unit 3 stores the digital data from the timing control unit 5 in its shift resister. Upon receipt of signals (LOAD) instructing to load the data onto the LCD panel 1, the data driving unit 3 selects the voltages corresponding to the respective data, and transmits the selected voltages to the LCD panel 1.

The scan driving unit 2, usually called the "gate driving unit", controls the data transmission from the data driving unit 3 to the pixels. Each pixel of the LCD panel 1 becomes an on or off state by turning on or off a thin film transistor (TFT) as a switching unit. The TFT is turned on or off depending on voltage Von or Voff applied to the gate thereof. The voltages Von and Voff are generated from the Von, Voff and Vcom generation unit 4. The Von, Voff and Vcom generation unit 4 generates the Von voltage and the Voff voltage as well as the Vcom voltage that is a reference value for the difference in the data voltage within the TFT.

The timing control unit 5 generates digital signals for driving the data driving unit 3 and the scan driving unit 2. Specifically, the timing control unit 5 generates signals for the scan driving unit 2 and the data driving unit 3, for controlling the timing of the data and for controlling the clock. The gray scale voltage generation unit 6 generates gray scale voltages for the data driving unit 3.

In the above-structured liquid crystal display, the polarity of the pixel electrode is inverted per at least two pixel rows. Furthermore, the horizontally neighboring pixel electrodes at one pixel row bear the opposite polarity. For this purpose, the timing control unit 5 generates driving signals for inversion-driving the LCD panel 1, and feeds them to the data driving unit 3 and the scan driving unit 2. The data driving unit 3 feeds gray scale voltages of the relevant polarity to the data lines in adaptation to the driving signals (the data signals) from the timing control unit 5.

Figure 4:
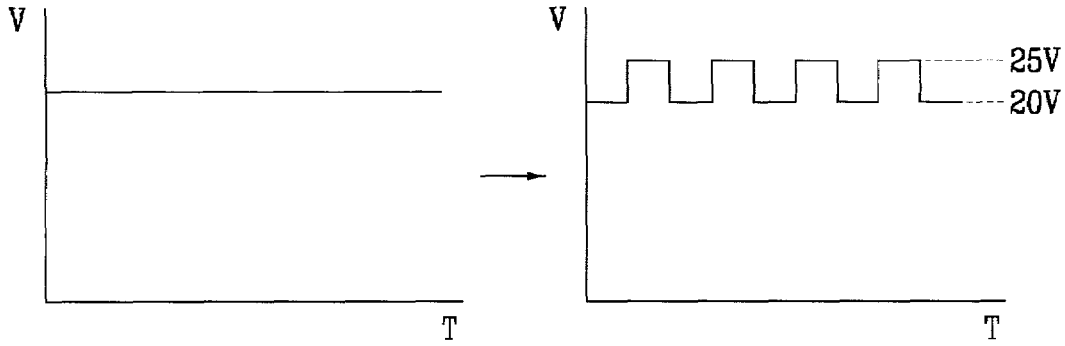
FIG. 4 is a graph illustrating the gate driving voltage characteristic per each pixel for the liquid crystal display shown in FIG. 3.

In order to prevent deterioration in the charge due to inversion in the polarity between the vertically neighboring pixels, the scan driving unit 2 applies gate driving signals Von to the pixels such that they are differentiated at the respective pixels. FIG. 4 illustrates the gate line driving voltage characteristic. Specifically, the scan driving unit 2 generates gate driving signals of variable value depending on the signal outputs from the timing control unit 5, and feeds them to the gate lines. For instance, in the 2-1dot inversion driving technique, the polarity of the pixel electrode is inverted per two pixel rows. When the neighboring pixel electrodes at the same pixel row bear the opposite polarity, the scan driving unit 2 generates gate driving signals inverted per a 1H cycle, and feeds them to the gate lines, thereby compensating for difference in the charge made per each line.

Figure 5:
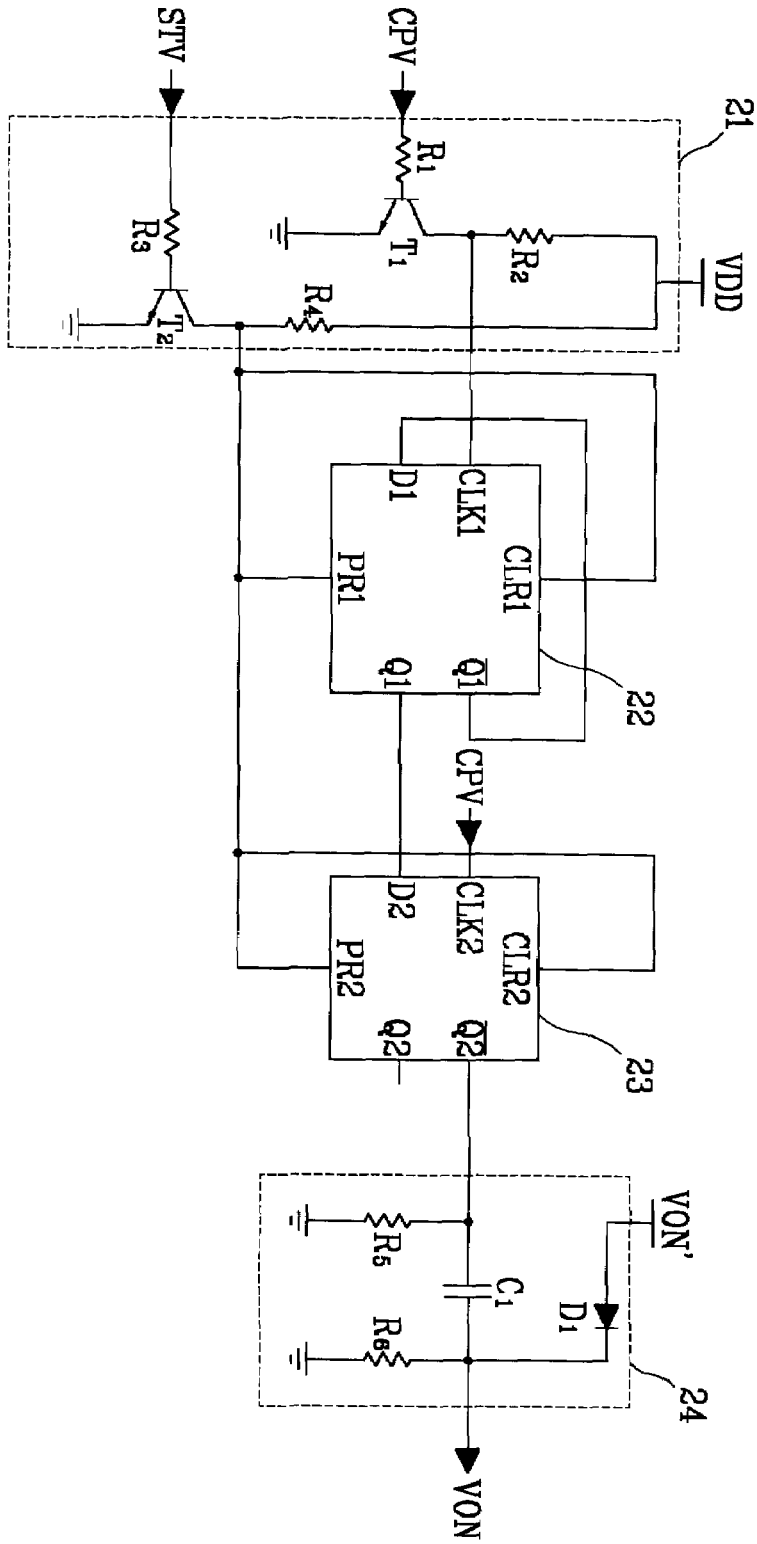
FIG. 5 is a circuit diagram illustrating the circuit structure of a scan driving unit for the liquid crystal display shown in FIG. 3.

FIG. 5 illustrates the structure of the scan driving unit 2 for feeding the gate driving signals to the LCD panel. As shown in FIG. 5, the scan driving unit 2 includes a signal generation unit 21 for generating a plurality of driving signals upon receipt of gate driving clocks CPV and horizontal synchronization pulses STV. First and second D-type flip-flops 22 and 23 are operated upon receiving the driving signals output from the signal generation unit 21 to generate signals that are inverted per a predetermined cycle. An output unit 24 stabilizes the signals output from the first and second D-type flip-flops 22 and 23.

The signal generation unit 21 includes a transistor T1 that switches between on and off states depending upon the gate driving clocks CPV, and a transistor T2 that switches between on and off states depending upon the horizontal synchronization pulses STV. Resistors R1 to R4 are connected to a base terminal and a collector terminal of each transistor T1 or T2.

The clock terminal CLK1 of the first D-type flip-flop 22 is connected to the collector terminal of the transistor T1, and the input terminal D1 is connected to the inversion output terminal Q1. The input terminal D2 of the second D-type flip-flop 23 is connected to the output terminal Q1 of the first flip-flop 22, and the clock terminal CLK2 is connected to the gate driving clock CPV. The clear terminals CLR1 and CLR2 and the pre-set terminals PR1 and PR2 of the first and the second D-type flip-flops 22 and 23, respectively, are connected to the collector terminal of the transistor T2. The operational characteristics of the D-type flip-flop are listed in Table 1.

TABLE 1

| Input | | | Output | | |
|---|---|---|---|---|---|
| PR | CLR | CLK | D | Q | /Q |
| L | H | X | X | H | L |
| H | L | X | X | L | H |
| L | L | X | X | H | H |
| H | H | ↑ | H | H | L |
| H | H | ↑ | L | L | H |
| H | H | L | X | Q0 | /Q0 |

Figure 6:
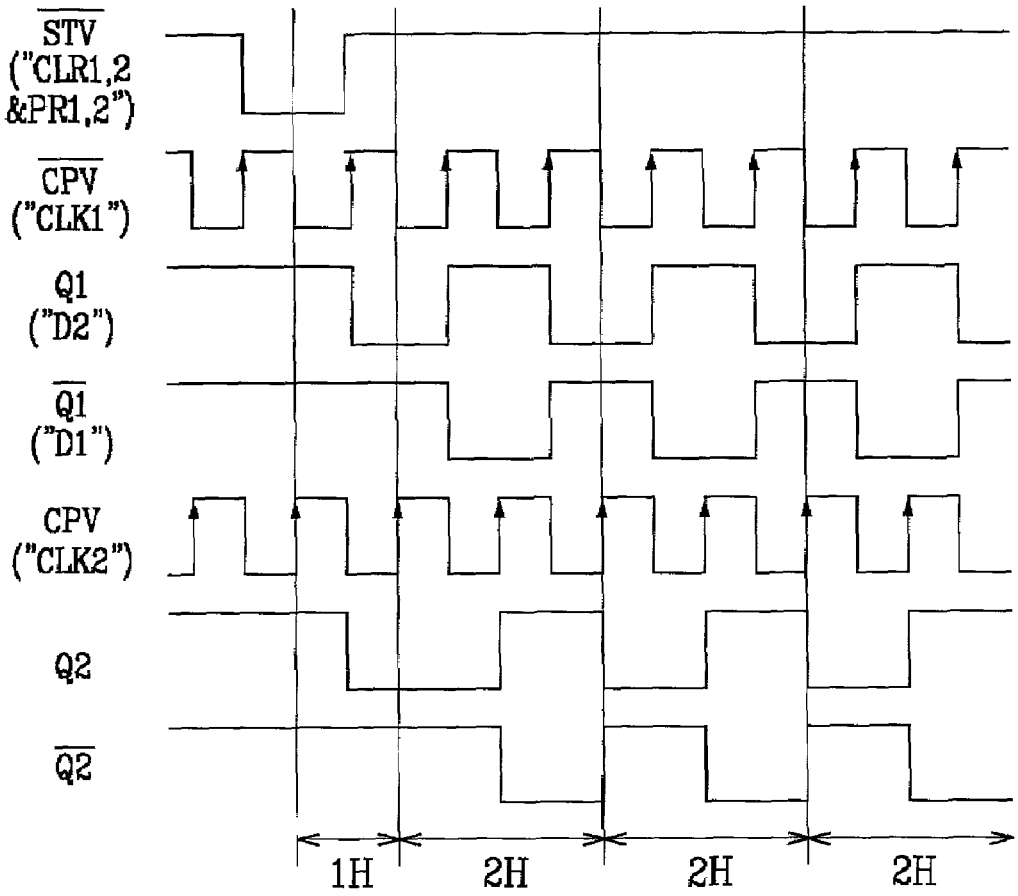
FIG. 6 is an operational timing diagram of the scan driving unit shown in FIG. 5.

The timing diagram of the above-structured scan driving unit is illustrated in FIG. 6, and the waveforms of the output voltages are illustrated in FIGS. 7A and 7B.

The transistors T1 and T2 turn on or off depending upon the gate driving clocks CPV and the horizontal synchronization pulses STV output from the timing control unit 5. With turning on or off of the transistors T1 and T2, the "L" or "H" level signals are input into the clock terminal CLK1 of the first D-type flip-flop 22, and the clear terminals CLR1 and CLR2 as well as the preset terminals PR1 and PR2 so that the D-type flip-flops 22 and 23 start to operate.

As shown in FIG. 6, when the "H" level gate driving clocks CPV and the horizontal synchronization pulses STV are input into the transistors T1 and T2, the transistors T1 and T2 turn on so that the "L" level signals are input into the clear terminals CLR1 and CLR2 and the preset terminals PR1 and PR2. In accordance with the operation characteristics listed in Table 1, the output of the first and the second D-type flip-flops 22 and 23 is maintained to be in the "H" state irrespective of the input.

Thereafter, when the "L" level gate driving clocks CPV and the horizontal synchronization pulses STV are input, the transistors T1 and T2 turn off so that the "H" signals are input into the clock terminal CLK of the first D-type flip-flop 22 as well as into the clear terminals CLR1 and CLR2 and the preset terminals PR1 and PR2. In accordance with the operational characteristics listed in Table 1, the first and the second D-type flip-flops 22 and 23 output the "H" or "L" level signals in synchronization with the clock terminals CLK1 and CLK2.

Figure 7:
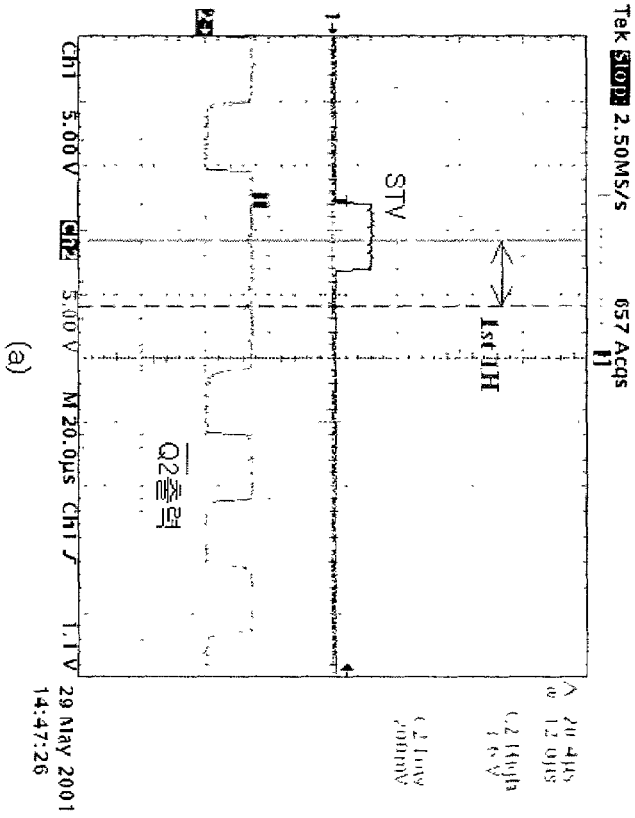
FIG. 7 is a graphs illustrating the waveforms of output voltages of the scan driving unit shown in FIG. 5.
Figure 7:
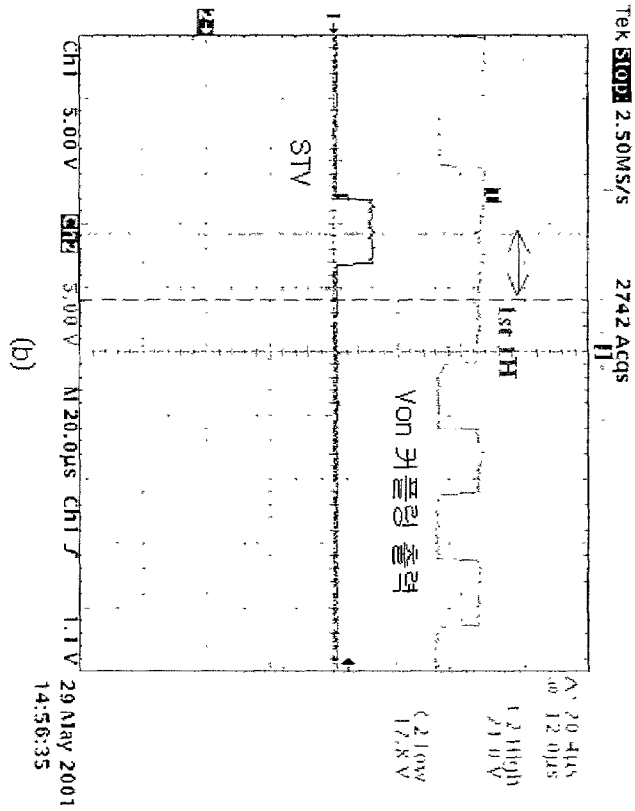

Meanwhile, as the inversion output terminal/Q1 of the first D-type flip-flop 22 is connected to the input terminal D1 of the first D-type flip-flop 22, signals having a level opposite to the input signals is output from the first D-type flip-flop 22, and input into the second D-type flip-flop 23. The signals are then output in synchronization with the gate driving clocks CPV input into the clock terminal CLK2 of the second D-type flip-flop 23. Accordingly, as shown in FIG. 6, the signals changed in the voltage level per 1H cycle in synchronization with the gate driving clocks CPV are output as the gate driving voltage Von. The waveform of the output voltages are illustrated in FIG. 7 as (a) and (b).

The circuit for generating the gate driving signals changed in the voltage level per predetermined cycle (for example, the 1H cycle) is not limited to the above-described structure, but may be structured in various manners. Furthermore, instead of the scan driving unit, the timing control unit may generate the signals changed in the voltage level per 1H cycle, and feed them to the required place.

A method for driving the above-structured liquid crystal display will be now explained in detail. The polarity of the respective pixels in the liquid crystal display is the same as that related to the 2-1 inversion driving technique. Upon receipt of picture signals Vs from a signal source (not shown), the timing control unit 5 processes the picture signals into data signals, and transmits the data signals to the data driving unit 3. Furthermore, the timing control unit 5 generates various kinds of timing signals required for driving the liquid crystal display such as gate driving clocks CPV and horizontal synchronization pulses STV.

The data driving unit 3 applies the data voltages (the gray scale voltages) to each pixel of the LCD panel 1 depending upon the data signals from the timing control unit 5. The scan driving unit 2 outputs the gate voltages as the gate driving signals that turn on the thin film transistor of each pixel to apply the data voltages to the pixel.

The gray scale voltages of the same polarity are fed to the respective pixels per two pixel rows. When the gate line of each pixel row is driven, gray scale voltages bearing a first polarity and gray scale voltages bearing a second polarity are alternately fed to the data line. Consequently, gray scale voltages of the opposite polarity are fed to the neighboring pixels at one pixel row, and voltages of the same polarity are fed to the pixels per two pixel rows.

Figure 1:
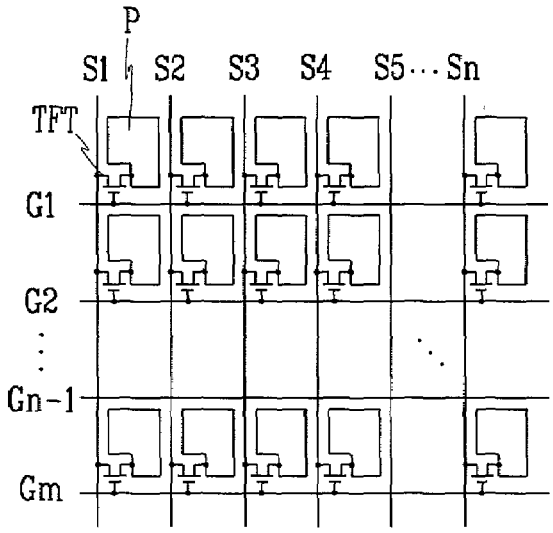
FIG.1(Prior Art)
FIG. 1 schematically illustrates the plane structure of a conventional liquid crystal display panel.
Figure 2A:
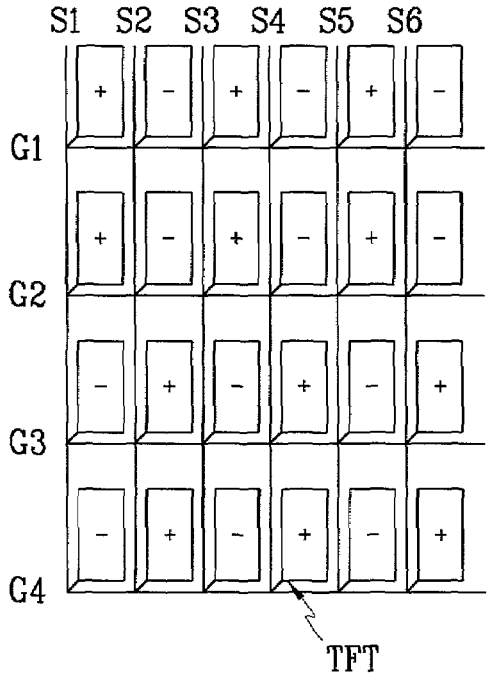
FIG.2A(Prior Art)
FIG. 2A illustrates the polarity of each pixel of a liquid crystal display where a 2-1 dot inversion driving technique is used.
Figure 2B:
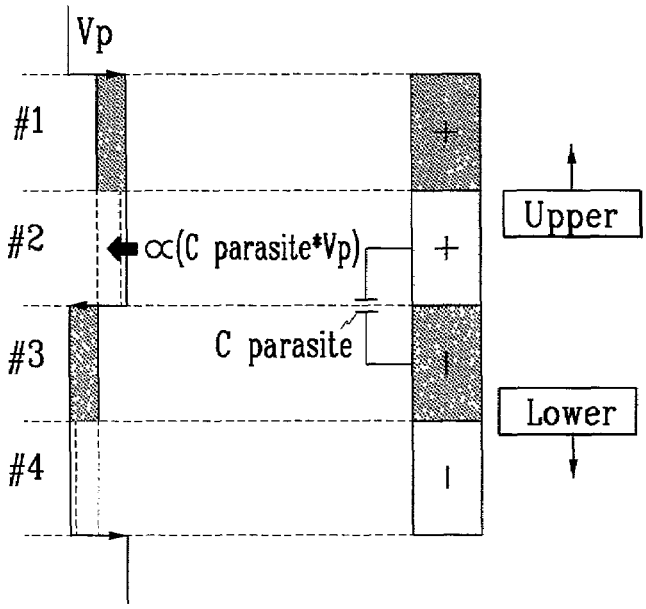
FIG.2B(Prior Art)
FIG. 2B illustrates the brightness of each pixel of the liquid crystal display shown in FIG. 2A.
Figure 2C:
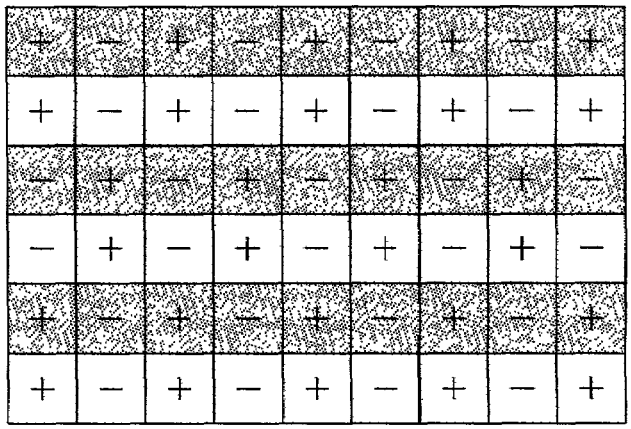
FIG.2C(Prior Art)
FIGS. 2C illustrates the voltage storage of each pixel of the liquid crystal display shown in FIG. 2A.

For instance, in case gray scale voltages are fed to the data lines while driving N numbers of gate lines in a sequential manner, they are fed to the data lines in the polarity order of "+, −, +, −, +, −, . . . " during the operation of the first and the second gate lines, while being fed thereto in the order of"−, +, −, +, −, +, . . . " during the operation of the third and fourth gate lines. As a result, the data lines bear the polarity distinction shown in FIG. 2A.

Figure 8:
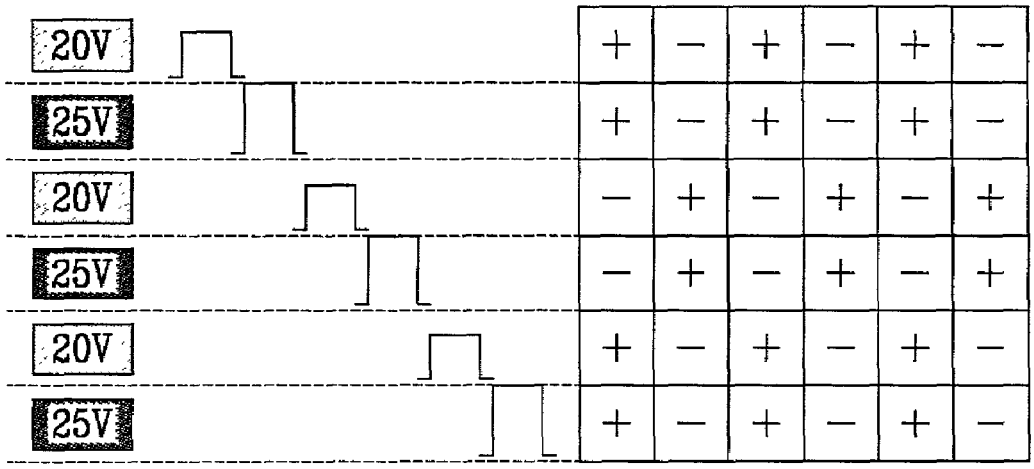
FIG. 8 illustrates the driving state of the gate lines for the liquid crystal display shown in FIG. 3 and the polarity state of the pixels pursuant thereto.

The scan driving unit 2 feeds the gate voltages changed in the voltage level per a cycle of 1H to each pixel electrode to charge the pixel electrode with sufficient voltage. That is, in order to prevent the parasitic capacitance between the vertically neighboring pixel electrodes from deteriorating the charge at the inversion of the voltage polarity due to, as shown in FIG. 8, a first gate voltage is fed to the first gate line, and a second gate voltage greater than the first gate voltage is fed to the second gate line. Furthermore, a first gate voltage is fed to the third gate line where the polarity of the gray scale voltages fed to the respective pixels varies, and a second gate voltage is fed to the fourth gate line.

As the gate lines (i.e., the second gate line, the fourth gate line, etc.) between the pixel rows of the opposite polarity receive greater gate voltage compared to the gate lines (i.e., the first gate line, the third gate line, etc.) between the pixel rows of the same polarity, deterioration in the voltage charge at the polarity inversion due to the parasitic capacitance between the vertically neighboring pixel electrodes can be prevented.

Meanwhile, if the voltage signal is delayed due to the slew rate without applying the gate voltage of an ideal square wave to the gate lines, the first gate line receives a gate voltage greater than the voltage of the second gate line. That is, a second gate voltage is fed to the first gate line, and a first gate voltage is fed to the second gate line. In this way, deterioration in the voltage charge due to the delay in the voltage signal is prevented. Accordingly, the same voltage charge is made at each pixel row per a gate line so that the entire screen brightness can be kept uniform. The gate driving signals (i.e., the gate voltages) may vary appropriately.

The above-described effects may be made also with respect to a 3-1 or 4-1 dot inversion type liquid crystal display where the inter-pixel polarity is inverted per three or four pixel rows. Furthermore, the gate voltage may bear two or more values.

As described above, in the inventive liquid crystal display where the inter-pixel polarity is inverted per two or more pixel rows, the brightness difference in the pixels due to the deteriorated voltage charge is compensated to keep brightness characteristic over the entire screen area uniform, while improving the display characteristic.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A liquid crystal display (LCD), comprising:

a scan driving unit generating a first gate voltage and a second gate voltage different from the first gate voltage and comprising a first D-type flip-flop and a second D-type flip-flop;

a data driving unit generating gray scale voltages;

a plurality of gate lines transmitting the first gate voltage and the second gate voltage from the scan driving unit;

a plurality of data lines crossing the gate lines and transmitting the gray scale voltages from the data driving unit;

a plurality of pixels arranged in a matrix form and divided into a plurality of pixel row groups, each pixel row group comprising a first pixel row and a second pixel row neighboring the first pixel row, polarities of the pixels being inverted per the pixel row group;

a plurality of pixel electrodes provided to the pixels, respectively; and a plurality of thin film transistors (TFTs) provided to the pixels, respectively, each TFT comprising a gate electrode connected to the corresponding gate line, a source electrode connected to the corresponding data line, and drain electrode connected to the corresponding pixel electrode, wherein the first gate voltage is transferred to the gate electrode of the first pixel row and the second gate voltage is transferred to the gate electrode of the second pixel row.

2. The liquid crystal display of claim 1, wherein the first gate voltage is higher than the second gate voltage.

3. A method of driving a liquid crystal display (LCD), the LCD comprising a scan driving unit comprising a first D-type flip-flop and a second D-type flip-flop, a data driving unit, a plurality of gate lines, a plurality of data lines, a plurality of pixels arranged in a matrix and divided into a plurality of pixel row groups, each pixel row group comprising a first pixel row and a second pixel row neighboring the first pixel row, a plurality of thin film transistors (TFTs) provided to the pixels, respectively, each TFT comprising a gate electrode connected to the corresponding gate line and a source electrode connected to the corresponding data line, the method comprising steps of:

inverting polarities of the pixels per the pixel row group; and feeding different gate voltages generated using the first D-type flip-flop and the second D-type flip-flop to the gate electrode of the first pixel row and the gate electrode of the second pixel row, respectively.

4. The method of claim 3, wherein the step of feeding the gate voltage comprises steps of:

feeding a first gate voltage to the first gate line;

feeding a second gate voltage to the second gate line, the first gate voltage being higher than the second gate voltage.

5. A method for driving a liquid crystal display(LCD), the LCD comprising a scan driving unit comprising a first D-type flip-flop and a second D-type flip-flop, a data driving unit, a plurality of gate lines, a plurality of data lines, a plurality of pixels divided into a plurality of pixel row groups, each pixel row group comprising a first pixel row and a second pixel row neighboring the first pixel row, and a plurality of thin film transistors (TFTs) provided corresponding to the pixels, each TFT comprising a gate electrode connected to the corresponding gate line and a source electrode connected to the corresponding data line, the method comprising a step of feeding different gate voltages generated using the first D-type flip-flop and the second D-type flip-flop to the gate electrode of the first pixel row and the gate electrode of the second pixel row, respectively.

* * * * *